US005247872A

United States Patent [19]

Hoshi

[11] Patent Number: 5,247,872

[45] Date of Patent: Sep. 28, 1993

[54] MULTI-STAGE HYDRAULIC ACTUATOR

[75] Inventor: Hideo Hoshi, 19-14, 3-chome, Maru-no-uchi, Naka-ku, Nagoya-shi, Aichi-ken, Japan

[73] Assignees: Hideo Hoshi, Nagoya, Japan; Mannesmann Rexroth GmbH, Lohr/Main, Fed. Rep. of Germany; a part interest

[21] Appl. No.: 985,659

[22] Filed: Dec. 7, 1992

[30] Foreign Application Priority Data

Dec. 27, 1991 [JP] Japan ..... 3-358729

[51] Int. Cl.[5] ..... F01B 7/20

[52] U.S. Cl. ..... 92/52; 92/53; 92/61; 92/62; 92/65; 91/167 R; 91/173; 91/181

[58] Field of Search ..... 92/51, 52, 53, 75, 61, 92/62, 65; 91/167 R, 170 R, 173, 508, 156, 181

[56] References Cited

U.S. PATENT DOCUMENTS

| | | | |
|---|---|---|---|
| 3,511,048 | 5/1970 | Nemetz | 92/61 |
| 3,610,100 | 10/1971 | Hoffman | 91/173 |
| 3,934,423 | 1/1976 | Haller | 92/62 |
| 5,111,733 | 5/1992 | Baraniak | 91/167 R |

FOREIGN PATENT DOCUMENTS

| | | | |
|---|---|---|---|
| 234167 | 4/1969 | U.S.S.R. | 91/167 |
| 0881382 | 11/1981 | U.S.S.R. | 92/62 |
| 1532412 | 11/1978 | United Kingdom | 92/75 |

*Primary Examiner*—Thomas E. Denion
*Attorney, Agent, or Firm*—Armstrong, Westerman, Hattori, McLeland & Naughton

[57] ABSTRACT

A multi-stage hydraulic actuator including a cylinder body having an outer cylinder and an inner cylinder provided in the outer cylinder, first and second pistons inserted in the outer cylinder to independently move and provided with first and second working members, and third and fourth pistons inserted in the inner cylinder to independently move and provided with third and fourth working members.

14 Claims, 6 Drawing Sheets

MULTI-STAGE HYDRAULIC ACTUATOR

BACKGROUND OF THE INVENTION

1. Field of the Invention

The present invention relates to a hydraulic actuator, and more precisely, relates to a multi-stage hydraulic actuator having an outer cylinder and an inner cylinder.

2. Description of Related Art

In a conventional hydraulic cylinder device, a single piston is usually reciprocally moved in a cylinder. A multi-stage cylinder device is also known, in which an auxiliary cylinder is provided in addition to a main cylinder. To carry out sequential operations using such a multi-stage cylinder device, it is usually necessary to actuate a plurality of cylinder devices in accordance with a predetermined sequence. This, however, results in complex and expensive operations.

The primary object of the present invention is to therefore provide a single hydraulic actuator in which a plurality of operations can be sequentially effected by a simple cylinder device.

Another object of the present invention is to provide a simple hydraulic actuator which ensures a precise operation without an eccentric load which would be otherwise applied thereto.

SUMMARY OF THE INVENTION

According to an aspect of the present invention, there is provided a multi-stage hydraulic actuator comprising a cylinder body having an outer cylinder and an inner cylinder provided in the outer cylinder, first and second pistons inserted in the outer cylinder to independently move and provided with first and second working members, and third and fourth pistons inserted in the inner cylinder to independently move and provided with third and fourth working members.

Preferably, the outer and inner cylinders define therein outer and inner pressure chambers which are divided into three outer and inner pressure chambers by the first and second pistons, and by the third and fourth pistons, respectively.

The cylinder body is provided with fluid ports which are connected to the respective divided outer and inner pressure chambers, so that pressurized fluid can be introduced in and discharged from the respective divided outer and inner pressure chambers.

Each of the first, second, third and fourth pistons is provided with a piston rod which extends through the cylinder body.

Preferably, some of the piston rods are comprised of a plurality of rod elements which are arranged along and on imaginary circles.

Further provision is made of fluid pipes connected to the first piston and the third piston so as to move together therewith and opening into the inner and outer pressure chamber defined between the first and second pistons and between the third and fourth pistons, respectively.

In a preferred arrangement, the first, second, third and fourth pistons are concentrically arranged. Similarly, the first, second, third and fourth working members are concentrically arranged.

BRIEF DESCRIPTION OF THE DRAWINGS

The present invention will be described below in detail, with reference to the accompanying drawings, in which.

DESCRIPTION OF THE PREFERRED EMBODIMENT

Figure 1:
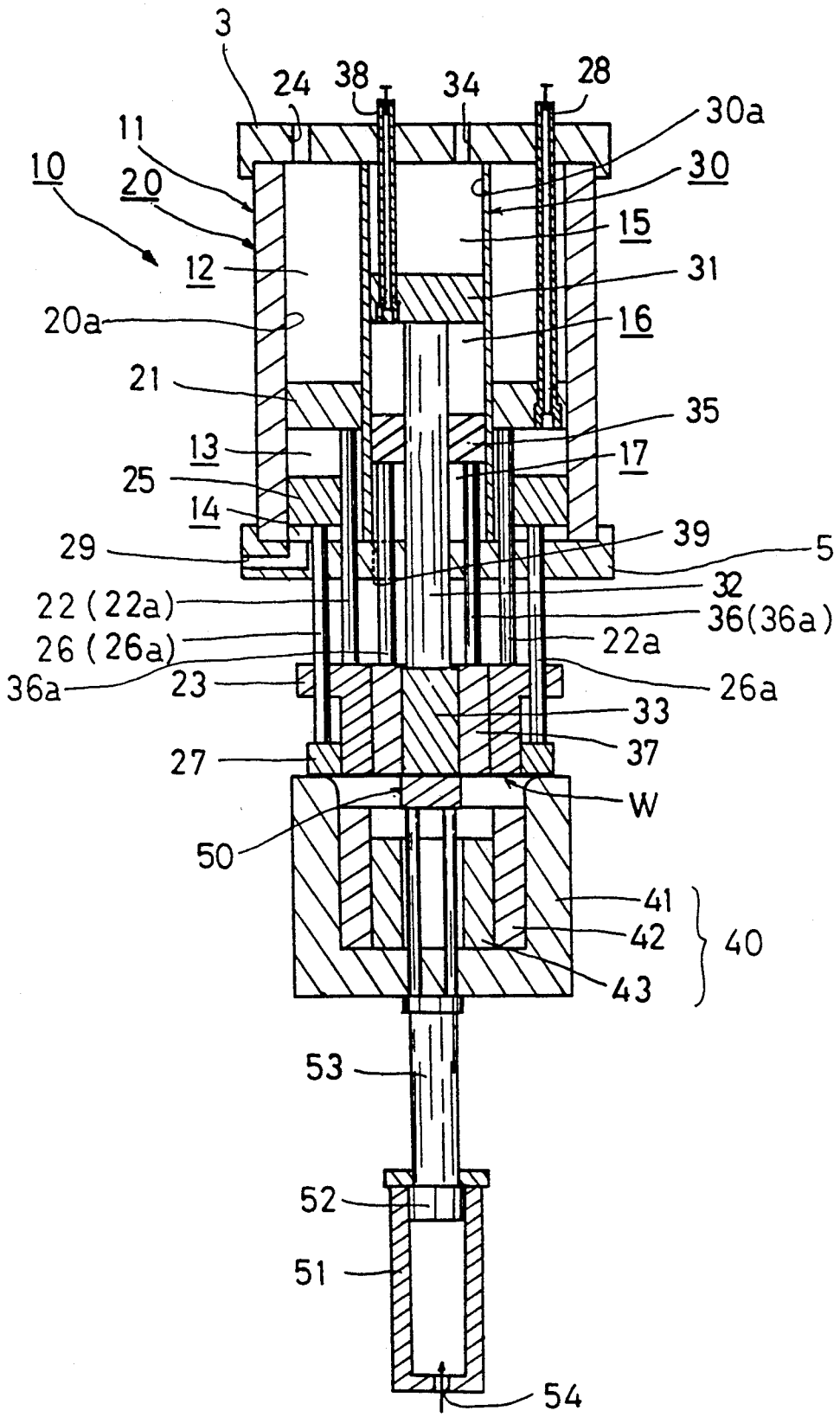
FIG. 1 is a longitudinal sectional view of a hydraulic actuator according to the present invention.

FIGS. 1 through 6 show an embodiment of the present invention, applied to a press machine 10.

The press machine 10 has a cylinder body 11 consisting of an outer cylinder 20 having an annular pressure chamber 20*a* and an inner cylinder 30 having a circular pressure chamber 30*a*. The inner cylinder 30 is housed in the outer cylinder 20 to define the annular pressure chamber 20*a* between the inner and outer cylinders 30 and 20.

First and second outer annular pistons 21 and 25 are inserted in the outer cylinder 20 to reciprocally move in the annular pressure chamber 20*a*. The first and second outer pistons 21 and 25 are slidably fitted on the inner cylinder 30.

Similarly, third and fourth pistons (first and second inner pistons)31 and 35 are inserted in the inner cylinder 30 to reciprocally move in the inner pressure chamber 30*a*. The outer pressure chamber 20*a* is divided into three pressure chambers, i.e., an upper outer pressure chamber 12, an intermediate outer pressure chamber 13, and a lower outer pressure chamber 14, by the first and second outer pistons 21 and 25.

Similarly, the inner pressure chamber 30*a* is divided into three pressure chambers, i.e., an upper inner pressure chamber 15, an intermediate inner pressure chamber 16, and a lower inner pressure chamber 17, by the first and second inner pistons 31 and 35.

The first outer piston 21 has a piston rod 22 secured thereto, consisting of a plurality of rod elements 22*a* which are arranged along an imaginary circle around the inner cylinder 30. The first piston 21 has a first drawing punch 23 connected to the front (lower) end of the piston rod 22. The first drawing punch 23 serves as a first working member.

The first outer piston 21 is actuated by pressurized fluid (e.g., pressurized oil) introduced in and discharged from the upper outer pressure chamber 12 and the lower outer pressure chamber 14 through oil ports 24 and 29 which are formed in end plates 3 and 5 secured to the outer cylinder 20 to constitute the cylinder body 11, respectively.

The second outer piston 25 has a piston rod 26 secured thereto, consisting of a plurality of rod elements 26*a* which are arranged on and along an imaginary circle around the first rod elements 22*a*. The second piston 25 has a pressure pad 27 (die cushion) connected to the lower ends of the second rod elements 26*a*. The pressure pad 27 constitutes a second working member.

The second piston 25 is actuated by pressurized fluid (e.g., pressurized oil) introduced in and discharged from the intermediate outer pressure chamber 13 and the lower outer pressure chamber 14 through a conduit 28 movably extending through the upper end plate 3 to be secured to the first outer piston 21 and the oil port 29, respectively. The conduit 28 is movable together with the first piston 21 and opens into the intermediate outer chamber 13.

A workpiece W to be pressed is placed on a stationary drawing die assembly 40 and a knock-out member 50 which is provided in the first drawing die assembly 40 to move in the axial direction of the piston rods 22 and 26. The die assembly 40 includes a first (outer) die 41, a second (intermediate) die 42 and a third (inner) die 43.

The knock-out member 50 is connected to a piston rod 53 which is

The knock-out member 50 is connected to a piston rod 53 which is in turn connected to a piston 52 slidably inserted in a knock-out cylinder 51. The knock-out cylinder 51 is actuated by pressurized fluid (e.g., pressurized oil) introduced in and discharged from an oil port 54 provided in the knock-out cylinder 51.

The third piston (first inner piston) 31 inserted in the inner cylinder 30 has a third piston rod 32 which extends through the fourth piston (second inner piston) 35 and the lower end plate 5 and which is provided on the front (lower) end thereof with a third drawing punch 33 which constitutes a third working member. The third piston (first inner piston) 31 is actuated by pressurized fluid (e.g., pressurized oil) introduced in and discharged from the oil ports 34 and 39.

The fourth piston (second inner piston) 35 inserted in the inner cylinder 30 has a fourth piston rod 36 which consists of a plurality of rod elements **36*a* extending through the lower end plate 5 and which is provided on the lower end thereof with a second drawing punch 34 which constitutes a fourth working member. The fourth piston 35 is actuated by pressurized oil introduced in and discharged from an oil pipe 38 in the axial direction thereof. The oil pipe 38 is connected to the third piston 31 and opens into the intermediate inner pressure chamber 16 so as to move together therewith in the axial direction thereof. The rod element 36*a* are arranged on and along an imaginary circle around the third piston rod 32**.

In an arrangement as shown in FIG. 1, in which the outer cylinder 20 in which the first and second pistons 21 and 25 are inserted has the annular pressure chamber **20*a* and the inner cylinder 30 in which the third and fourth pistons 31 and 35 are inserted has the circular pressure chamber 30*a*, since each of the piston rods 22, 26 and 36 secured to the respective pistons is made of a plurality of rod elements 22*a*, 26*a* and 36*a*** which are uniformly arranged on and along the respective imaginary circles, as mentioned above, a uniform load can be circumferentially applied to a workpiece which would otherwise receive an eccentric load.

The press machine as constructed above operates as follows.

In FIG. 1 in which the second piston 25 is advanced to bring the pressure pad 27 into press contact with the workpiece W, predetermined amounts of pressurized oil are introduced into the intermediate outer pressure chamber 13 of the outer cylinder 20 and the intermediate inner pressure chamber 13 of the inner cylinder 30 through the oil pipes 28 and 38, respectively. The valves (not shown) provided in the oil passages connected to the oil pipes 28 and 38 are closed. In FIG. 1, the knock-out piston 52 is moved upward, so that the knock-out member 50 comes into contact with the lower surface of the workpiece W.

Figure 2:
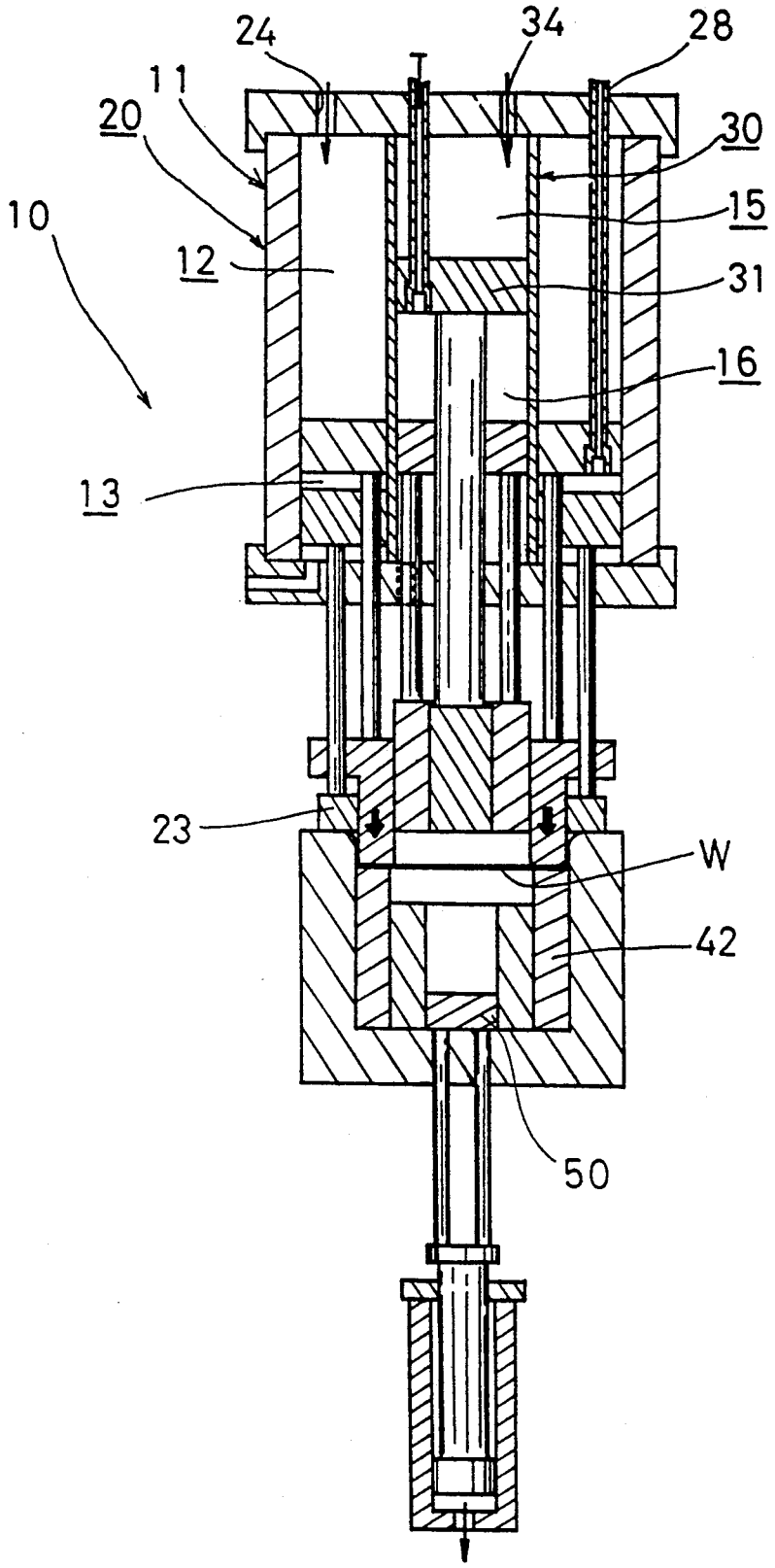
FIG. 2 through 4 are longitudinal sectional views of a hydraulic actuator shown in different press positions, according to the present invention.

The first drawing operation is carried out as shown in FIG. 2, in which the pressurized oil of the knock-out cylinder 51 is discharged therefrom to move the knock-out piston 52 in the downward direction.

To advance the first piston 21, the pressurized oil is introduced into the upper outer pressure chamber 12 through the oil port 24 and the pressurized oil in the intermediate outer pressure chamber 13 is gradually discharged therefrom through the oil pipe 28 while retaining a predetermined internal pressure (control of back pressure). The control of the back pressure in the intermediate outer pressure chamber 13 enhances the die cushion effect.

The advance of the first piston 21 causes the first working member (first drawing punch) 23 to advance, so that the front end thereof comes into contact with the second second drawing die 42 to complete the first drawing operation of the workpiece.

Thereafter, the pressurized oil is introduced into the third pressure chamber (upper inner pressure chamber) 15 through the oil port 34 of the inner cylinder 30 to actuate the third piston 31. Since the valve of the oil pipe 38 is closed as mentioned above, the pressurized oil enclosed in the intermediate inner pressure chamber 16 serves as a fluid (rigid) connector to actuate the third piston 31 and the fourth piston 35 together.

Figure 3:
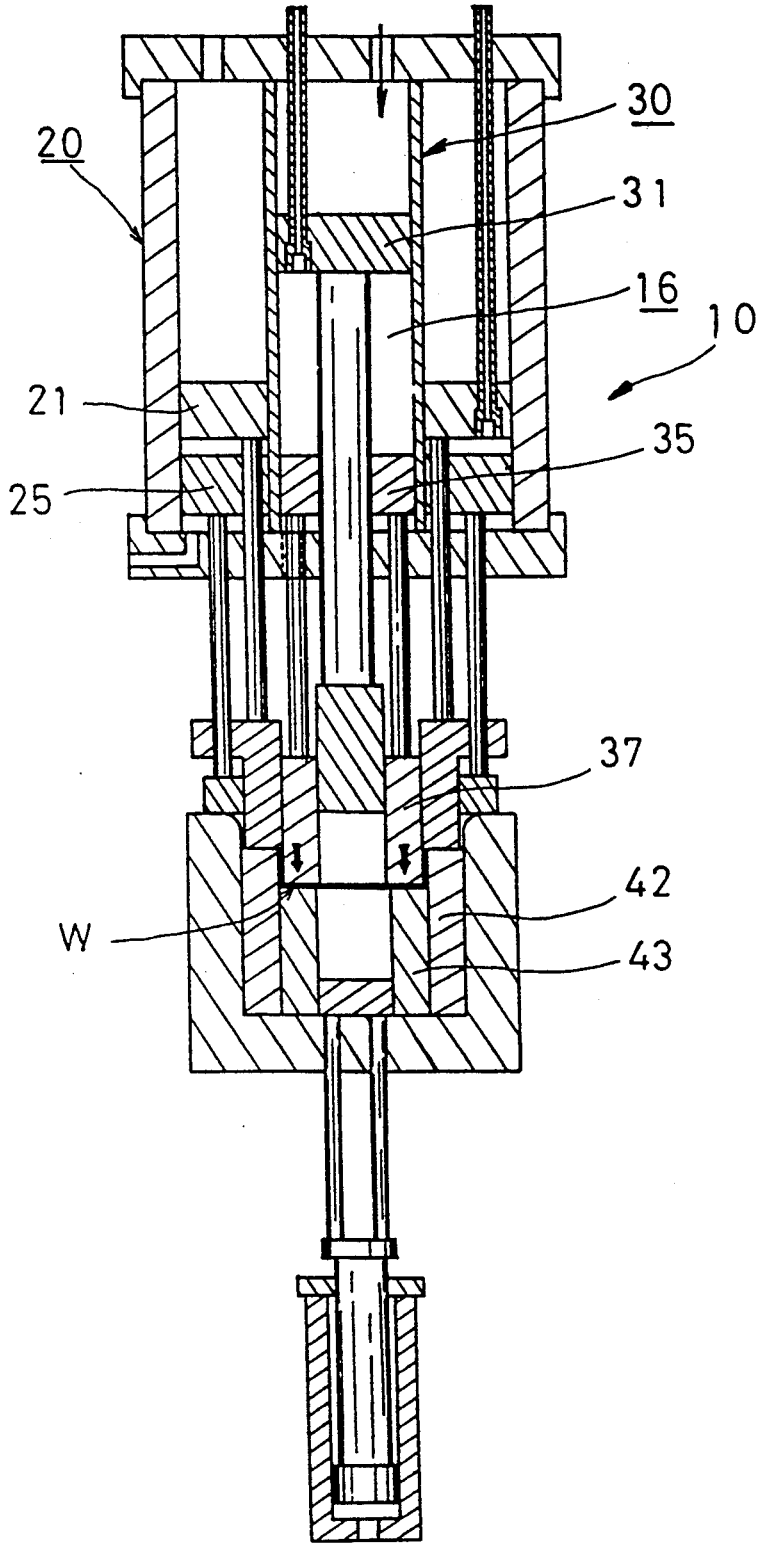

As a result, as can be seen in FIG. 3, the second drawing punch 37 of the fourth piston 35 is lowered in and along the second drawing die 42, so that the second drawing punch 37 comes into contact with the upper surface of the third drawing die 43 through the workpiece W to complete the second drawing operation.

Figure 4:
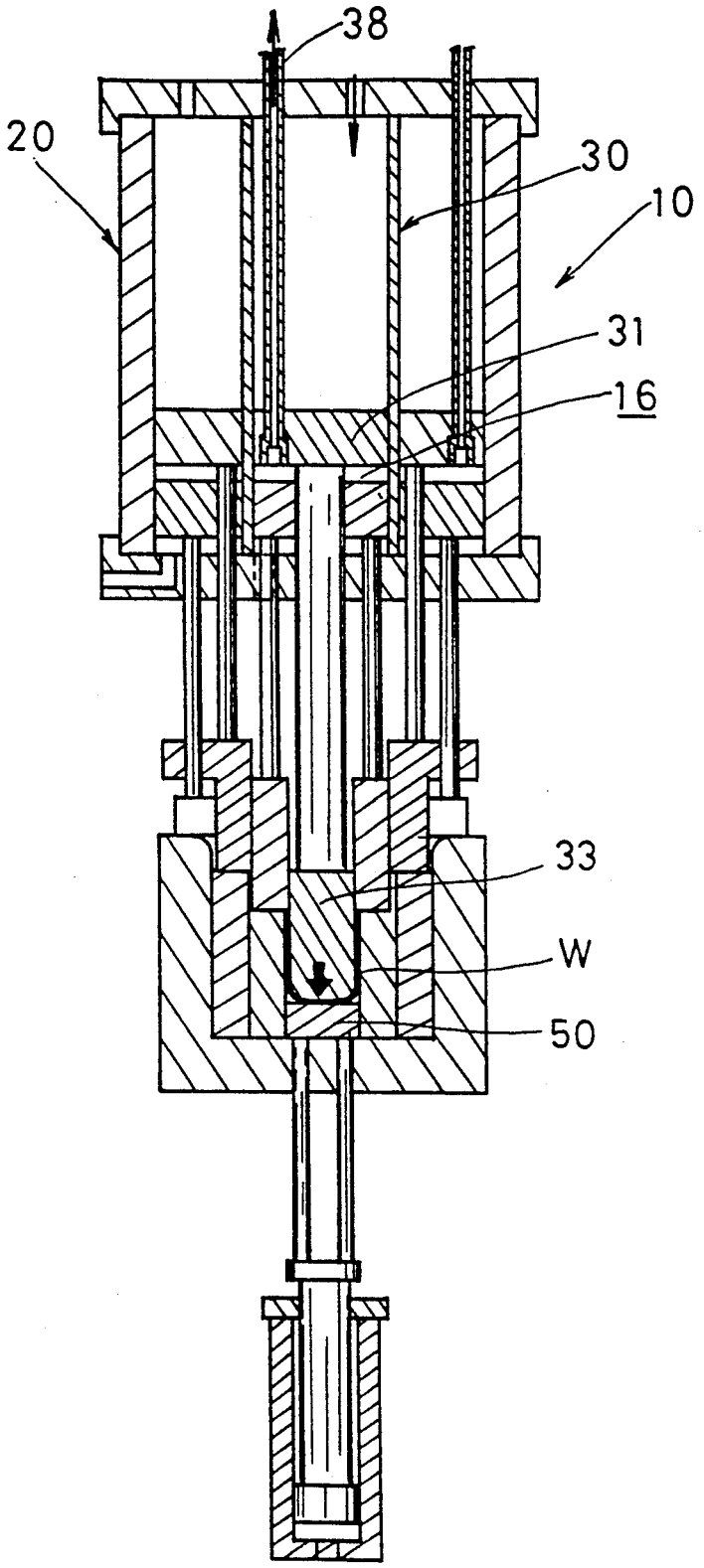

Thereafter, as shown in FIG. 4, the valve of the oil pipe 38 of the inner cylinder 30 is opened, and the pressurized oil in the intermediate inner pressure chamber 16 is gradually discharged therefrom. As a result, the third piston 31 is lowered to bring the third drawing punch 33 into contact with the knock-out member 50 through the workpiece W, so that the workpiece W is pressed into a desired shape. At the same time, the knock-out member 50 is lowered.

Figure 5:
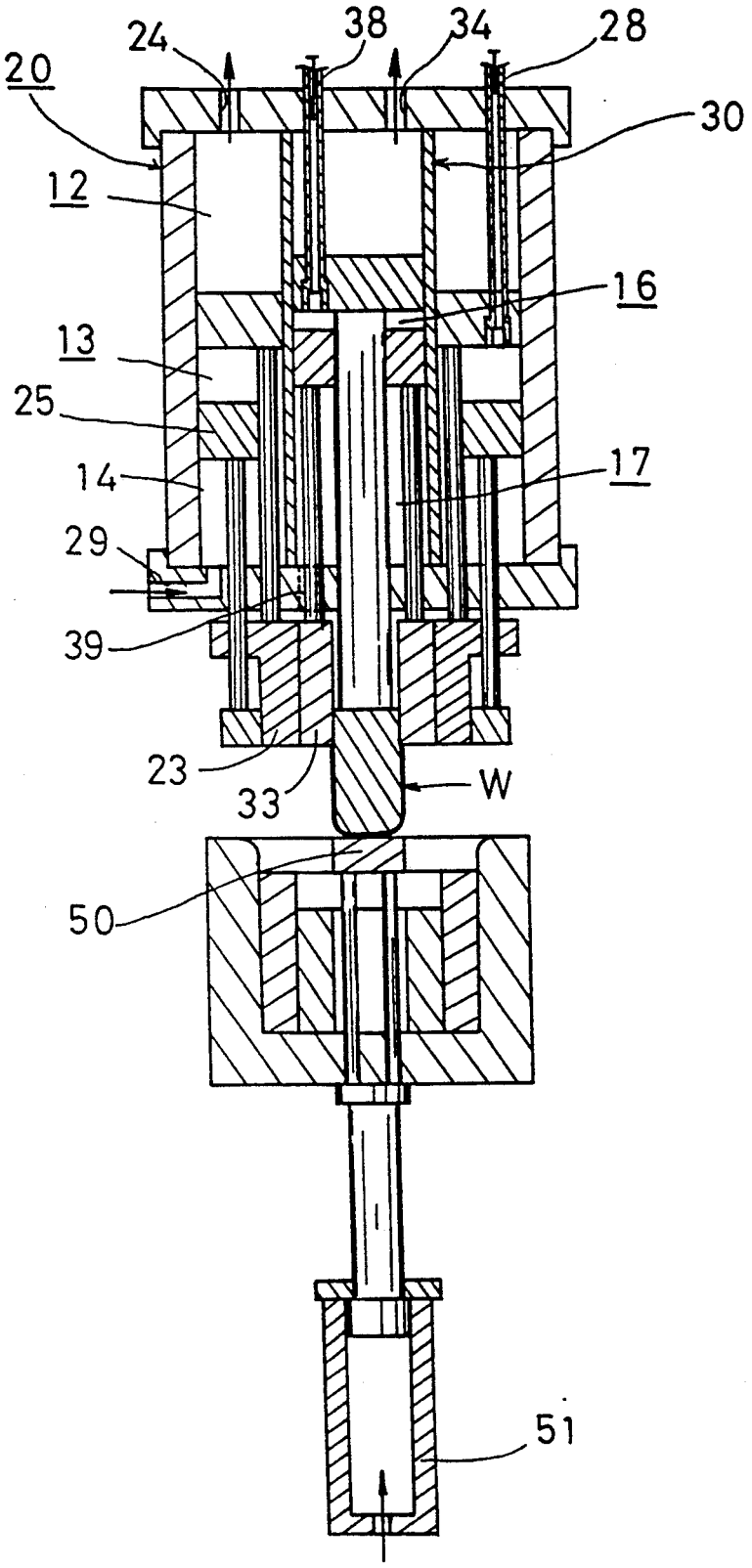
FIG. 5 is a longitudinal sectional view of a hydraulic actuator shown in an ejection position of a workpiece, according to the present invention; and, FIG. 6 is a longitudinal sectional view of a hydraulic actuator shown in a removal position of a workpiece, according to the present invention.

FIG. 5 shows an ejection position of the workpiece thus pressed. In FIG. 5, the pressurized oil is introduced into the knock-out cylinder 51 to move the knock-out member 50 in the upward direction. At the same time, the pressurized oil is introduced into the lower outer pressure chamber 14 of the outer cylinder 20 and the lower inner pressure chamber 17 of the inner chamber 30 through the oil ports 29 and 39, respectively.

In FIG. 5, the valves (not shown) of the oil passages of the oil pipes 28 and 38 connected to the intermediate outer pressure chamber 13 and the intermediate inner pressure chamber 16, respectively are closed, so that the pressurized oils enclosed therein serve as fluid (rigid) connectors to retract the first, second, third and fourth pistons 21, 25, 31 and 35 together.

During the backward movement of the first and third pistons 21 and 31, the pressurized oil in the upper outer and inner pressure chambers 12 and 15 is discharged therefrom.

Figure 6:
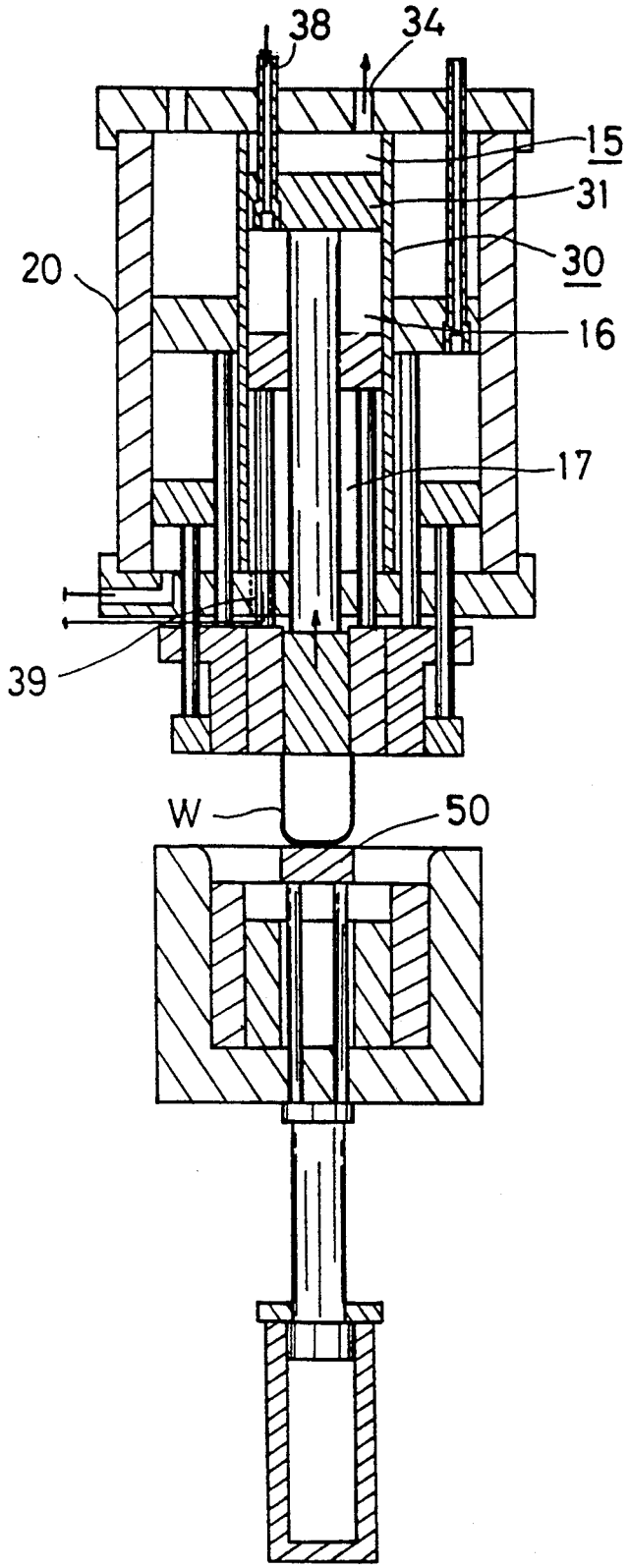

FIG. 6 shows a removal position of the workpiece W from the punches. In FIG. 6, the valve of the passage connected to the oil port 39 of the third pressure chamber (lower inner pressure chamber) 17 of the inner cylinder 30 is closed and the pressurized oil is introduced into the second pressure chamber (intermediate inner pressure chamber) 16 through the oil pipe 38 when the first drawing punch 23 and the second drawing punch 33 are moved to predetermined upper positions, respectively.

The introduction of the pressurized oil into the intermediate inner pressure chamber 16 causes the pressurized oil in the first pressure chamber (upper inner pressure chamber) 15 to be discharged therefrom through the oil port 34. Since the internal pressure of the third pressure chamber (lower inner pressure chamber) 17 is kept constant by the closed valve of the oil passage of the oil port 39, the upward movement of the third piston 31 only takes place, so that the pressed workpiece W is held on the knock-out member 50, as shown in FIG. 6.

As can be understood from the foregoing, according to the present invention, a plurality of operations are carried out by a single and simple hydraulic actuator, and accordingly, a space necessary to accommodate the hydraulic actuator can be minimized, and the conveyance of the workpieces can be simplified, thus resulting in an effective energy utilization and a decreased labor.

Furthermore, according to the present invention, the uniform arrangement of the rod elements of which the piston rods are made ensures a precise machining of a workpiece to which no eccentric load is applied. Consequently, the hydraulic actuator according to the present invention can be advantageously applied particularly to a press machine.

I claim:

1. A multi-stage hydraulic actuator comprising a cylinder body having an outer cylinder and an inner cylinder provided in the outer cylinder, first and second pistons inserted in the outer cylinder to independently move and provided with first and second working members, and third and fourth pistons inserted in the inner cylinder to independently move and provided with third and fourth working members;

wherein said outer and inner cylinders define therein outer and inner pressure chambers, respectively; and wherein said inner cylinder is provided in the outer pressure chamber.

2. A multi-stage hydraulic actuator according to claim 1, wherein said outer pressure chamber is divided into three outer pressure chambers by the first and second pistons.

3. A multi-stage hydraulic actuator according to claim 2, wherein said inner pressure chamber is divided into three inner pressure chambers by the third and fourth pistons.

4. A multi-stage hydraulic actuator according to claim 3, wherein said cylinder body is provided with fluid ports which are connected to the respective divided outer and inner pressure chambers, so that pressurized fluid can be introduced in and discharged from the respective divided outer and inner pressure chambers.

5. A multi-stage hydraulic actuator according to claim 4, wherein said first piston is provided with a first piston rod which extends through the second piston and the cylinder body, so that the first working member is secured to the outer end of the first piston rod.

6. A multi-stage hydraulic actuator according to claim 5, wherein said first piston rod is comprised of a plurality of rod elements which are arranged along and on an imaginary circle.

7. A multi-stage hydraulic actuator according to claim 6, wherein said second piston is provided with a second piston rod which extends through the cylinder body, so that the second working member is secured to the outer end of the second piston rod.

8. A multi-stage hydraulic actuator according to claim 7, wherein said third piston is provided with a third piston rod which extends through the fourth piston and the cylinder body, so that the third working member is secured to the outer end of the third piston rod.

9. A multi-stage hydraulic actuator according to claim 8, wherein said fourth piston is provided with a fourth piston rod which extends through the cylinder body, so that the fourth working member is secured to the outer end of the fourth piston rod.

10. A multi-stage hydraulic actuator according to claim 9, wherein said fourth piston rod is comprised of a plurality of rod elements which are arranged along and on an imaginary circle.

11. A multi-stage hydraulic actuator according to claim 10, further comprising a fluid pipe connected to the first piston so as to move together therewith and opening into the outer pressure chamber defined between the first and second pistons.

12. A multi-stage hydraulic actuator according to claim 11, further comprising a second fluid pipe connected to the third piston so as to move together therewith and opening into the inner pressure chamber defined between the third and fourth pistons.

13. A multi-stage hydraulic actuator according to claim 12, wherein said first, second, third and fourth pistons are concentrically arranged.

14. A multi-stage hydraulic actuator according to claim 13, wherein said first, second, third and fourth working members are concentrically arranged.

* * * * *